US012478189B2

(12) United States Patent
Chung

(10) Patent No.: US 12,478,189 B2
(45) Date of Patent: Nov. 25, 2025

(54) READY-TO-ASSEMBLE BED

(71) Applicant: Plusmofa International Ltd., Miaoli (TW)

(72) Inventor: Yu-Wei Chung, Miaoli (TW)

(73) Assignee: Plusmofa International Ltd., Miaoli (TW)

( * ) Notice: Subject to any disclaimer, the term of this patent is extended or adjusted under 35 U.S.C. 154(b) by 37 days.

(21) Appl. No.: 18/662,108

(22) Filed: May 13, 2024

(65) Prior Publication Data

US 2025/0344870 A1 Nov. 13, 2025

(51) Int. Cl.

| | |
|---|---|
| ***A47C 19/00*** | (2006.01) |
| ***A47C 19/02*** | (2006.01) |
| ***A47C 27/00*** | (2006.01) |
| ***A47C 27/06*** | (2006.01) |

(52) U.S. Cl.

CPC ..... *A47C 19/005* (2013.01); *A47C 27/001* (2013.01); *A47C 19/022* (2013.01); *A47C 19/025* (2013.01); *A47C 27/002* (2013.01); *A47C 27/062* (2013.01)

(58) Field of Classification Search

CPC ... A47C 27/001; A47C 27/002; A47C 27/062; A47C 19/005; A47C 19/022; A47C 19/025

See application file for complete search history.

(56) References Cited

U.S. PATENT DOCUMENTS

| | | | | |
|---|---|---|---|---|
| 4,077,074 | A * | 3/1978 | Fogel | A47C 27/085 5/915 |
| 4,970,743 | A * | 11/1990 | Wride | A47C 27/085 5/915 |
| 7,017,205 | B2 * | 3/2006 | Gladney | A47C 19/022 5/400 |
| 2011/0203050 | A1 * | 8/2011 | Rogers | A47C 19/005 5/285 |
| 2022/0211177 | A1 * | 7/2022 | Chung | A47B 91/005 |

* cited by examiner

*Primary Examiner* — Adam C Ortiz

(74) *Attorney, Agent, or Firm* — MUNCY, GEISSLER, OLDS & LOWE, P.C.

(57) ABSTRACT

A ready-to-assemble bed includes a bed base, a replaceable resilient cushion, a contact pad, and a headboard. The replaceable resilient cushion is placed on the bed base and has a first encasement that has spring-based resilient chunks removably filled therein. The contact pad is placed on the replaceable resilient cushion and detachably combined with the replaceable resilient cushion. The contact pad includes a second encasement that has a support member removably filled therein. The headboard is detachably combined with the bed base. Thereby, a user of the ready-to-assemble bed can make up the replaceable resilient cushion with the spring-based resilient chunks having different hardness levels according to practical needs and thereby provide the user's different body portions with suitable support.

10 Claims, 8 Drawing Sheets

READY-TO-ASSEMBLE BED

BACKGROUND OF THE INVENTION

1. Technical Field

The present invention relates to beds, and more particularly to a ready-to-assemble bed.

2. Description of Related Art

Most existing beds are composed of a monolithic base and a mattress placed thereon. Mattresses for this purpose are mainly in either of two types, namely pocket-spring mattresses and innerspring mattresses.

In a typical innerspring mattress, springs are interconnected. When being pressed, the mattress tends to give friction-induced noise and leave gaps between the human body and its surface because it sags as a whole and is unable to fit the profile of the human body. As an improvement, a pocket-spring mattress is constructed from separate springs each sealed in a pocket made of non-woven fabric and then connected in series to form the mattress. The springs bear loads and resile independently of each other, so they can support different portions of a human body with different strength levels. This non-interfering relation among the springs ensures more relevant support performance and user comfort.

However, the existing pocket-spring mattresses have their defects. Specifically, since the springs forming a mattress are usually of the same specifications, the resulting mattress does not provide different hardness levels and support levels in different regions. This limits its ability to cater to users of different body shapes and weights. For example, with an existing pocket-spring double mattress, it is very likely that at least one of two persons sharing the same bed will feel that he/she is less supported or feel that the mattress is too hard. In an example where a pocket-spring single mattress is involved, the user may have one of his/her body portions less supported and feel that the mattress is too hard at his/her other body portions.

Another defect of the traditional, one-piece mattresses is that even if there is only one spring failed in the mattress, the mattress may have to be discarded as a whole, making its use relatively costly and less environmentally friendly.

SUMMARY OF THE INVENTION

To address the shortcomings of the prior-art devices, the present invention provides a ready-to-assemble bed, which has spring-based resilient chunks of different hardness levels for a user to select and make up a mattress specifically to his/her personal needs wherein the spring-based resilient chunks can be replaced independently in case of damage, making use of this ready-to-assemble bed environmentally friendly.

The present invention hence in one embodiment provides a ready-to-assemble bed, which comprises a first base member, a second base member, a connecting member, a replaceable resilient cushion, a contact pad, and a headboard. The first base member has a first installation notch and a combination notch opposite to each other in a horizontal direction. The second base member has a second installation notch in the horizontal direction. The connecting member has a first insertion portion and a second insertion portion extending outward from two sides thereof. The first insertion portion is configured to be detachably combined with the first installation notch. The second insertion portion is configured to be detachably combined with the second installation notch. The first base member and the second base member when combined are adjacent and positioned abreast in a longitudinal direction. The replaceable resilient cushion is placed on the first base member and the second base member. The replaceable resilient cushion has a first encasement and a plurality of spring-based resilient chunks configured to be removably filled in the first encasement. The contact pad is placed on the replaceable resilient cushion and is detachably combined with the replaceable resilient cushion. The contact pad has a second encasement and a support member configured to be removably filled in the second encasement. The headboard has a fixation portion. The fixation portion is configured to be detachably combined with the combination notch.

In another embodiment of the present invention, a ready-to-assemble bed comprises two first base members, two second base members, two connecting members, a plurality of transverse-connection members, a replaceable resilient cushion, a contact pad, and a headboard. The first base member has a first installation notch and a combination notch opposite to each other in a horizontal direction. The first base member has a first lateral connection notch. The first lateral connection notch is perpendicular to the first installation notch. The second base member has a second installation notch in the horizontal direction and a second lateral connection notch perpendicular to the second installation notch. The connecting member has a first insertion portion and a second insertion portion extending outward from two sides thereof. The first insertion portion is configured to be detachably combined with the first installation notch. The second insertion portion is configured to be detachably combined with the second installation notch. The first base members and the second base members are adjacent and positioned abreast in a longitudinal direction. The transverse-connection members are detachably combined with the two adjacent first lateral connection notches, so that the first base members are adjacent and positioned abreast in a transverse direction, and are detachably combined with the two adjacent second lateral connection notches, so that the second base members are adjacent and positioned abreast in the transverse direction. The replaceable resilient cushion is placed on the first base members and the second base members. The replaceable resilient cushion has a first encasement and a plurality of spring-based resilient chunks to be filled in or removed from the first encasement. The contact pad is placed on the replaceable resilient cushion, and is detachably combined with the replaceable resilient cushion. The contact pad has a second encasement and a support member to be filled in or removed from the second encasement. The headboard has a plurality of fixation portion. The fixation portion is configured to be detachably combined with the combination notch.

Thereby, a user of the disclosed bed can make up the replaceable resilient cushion with the spring-based resilient chunks having different hardness levels according to practical needs and thereby provide his/her different body portions with suitable support. In addition, when any of the spring-based resilient chunks has a failure, the user can replace the failed one with a new chunk without discarding other sound chunks, making use of the disclosed bed favorable to environmental protection.

DETAILED DESCRIPTION OF THE INVENTION

Figure 1:
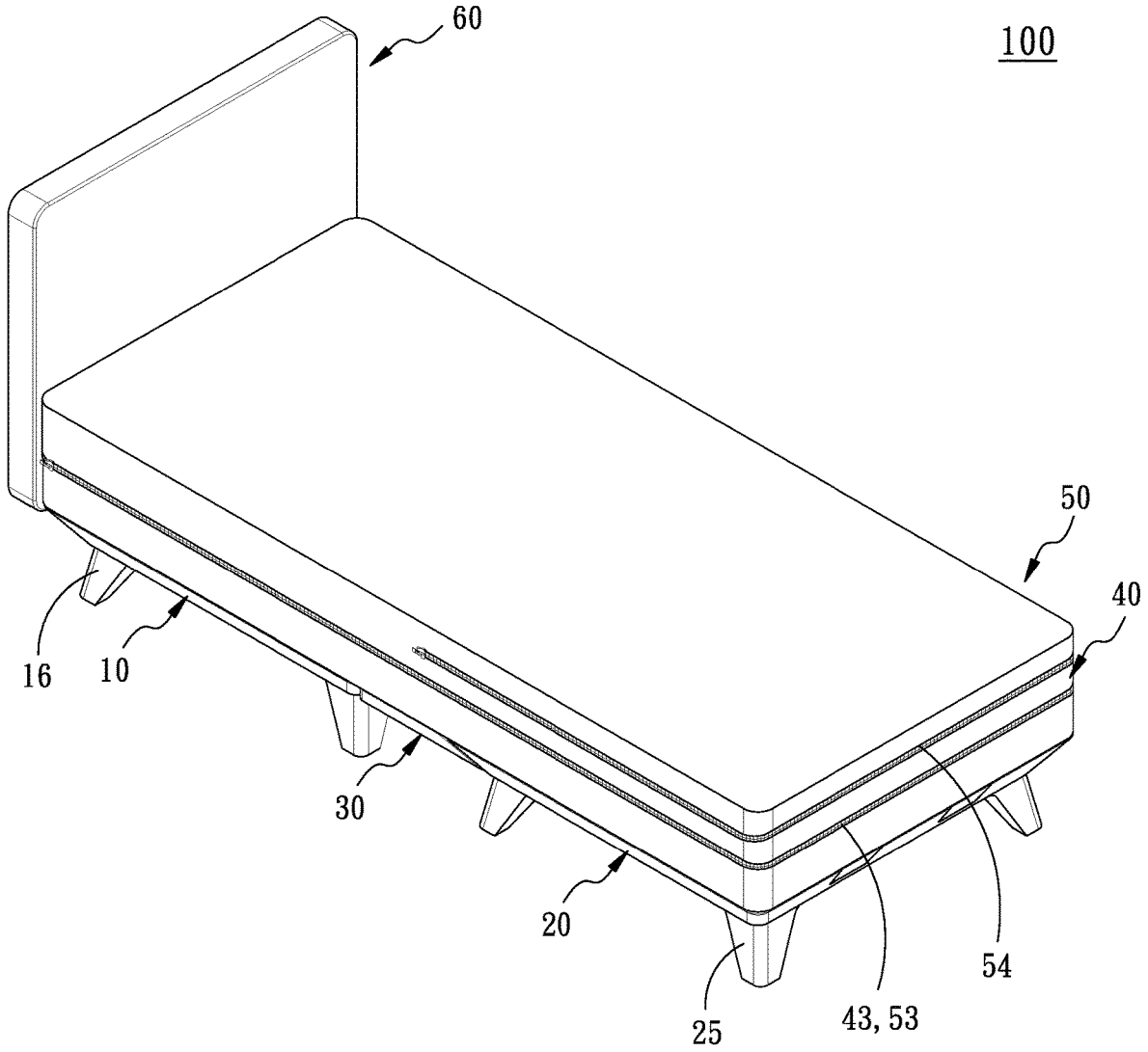
FIG. 1 is a perspective view of a ready-to-assemble bed according to a first embodiment of the present invention, wherein the ready-to-assemble bed is a single bed.

For further illustrating the means and functions by which the present invention achieves the certain objectives, the following description, in conjunction with the accompanying drawings and preferred embodiments, is set forth as below to illustrate the implementation, structure, features and effects of the subject matter of the present invention.

Moreover, as the contents disclosed herein should be readily understood and can be implemented by a person skilled in the art, all equivalent changes or modifications which do not depart from the concept of the present invention should be encompassed by the appended claims.

In the following description and the appended claims, where an ordinal number such as "first," "second," or "third" is used, it is intended to describe the associated element and does not mean any sequence between some claimed element and another claimed element. Similar yet not necessarily identical parts of different preferred embodiments may be indicated with the same reference numerals, and repeated description will be omitted.

Referring to FIG. 1 through FIG. 5, in the first embodiment of the present invention, a ready-to-assemble bed 100 is a single bed, which comprises a first base member 10, a second base member 20, and a connecting member 30 that jointly form a bed base; a replaceable resilient cushion 40; a contact pad 50; and a headboard 60.

Figure 3:
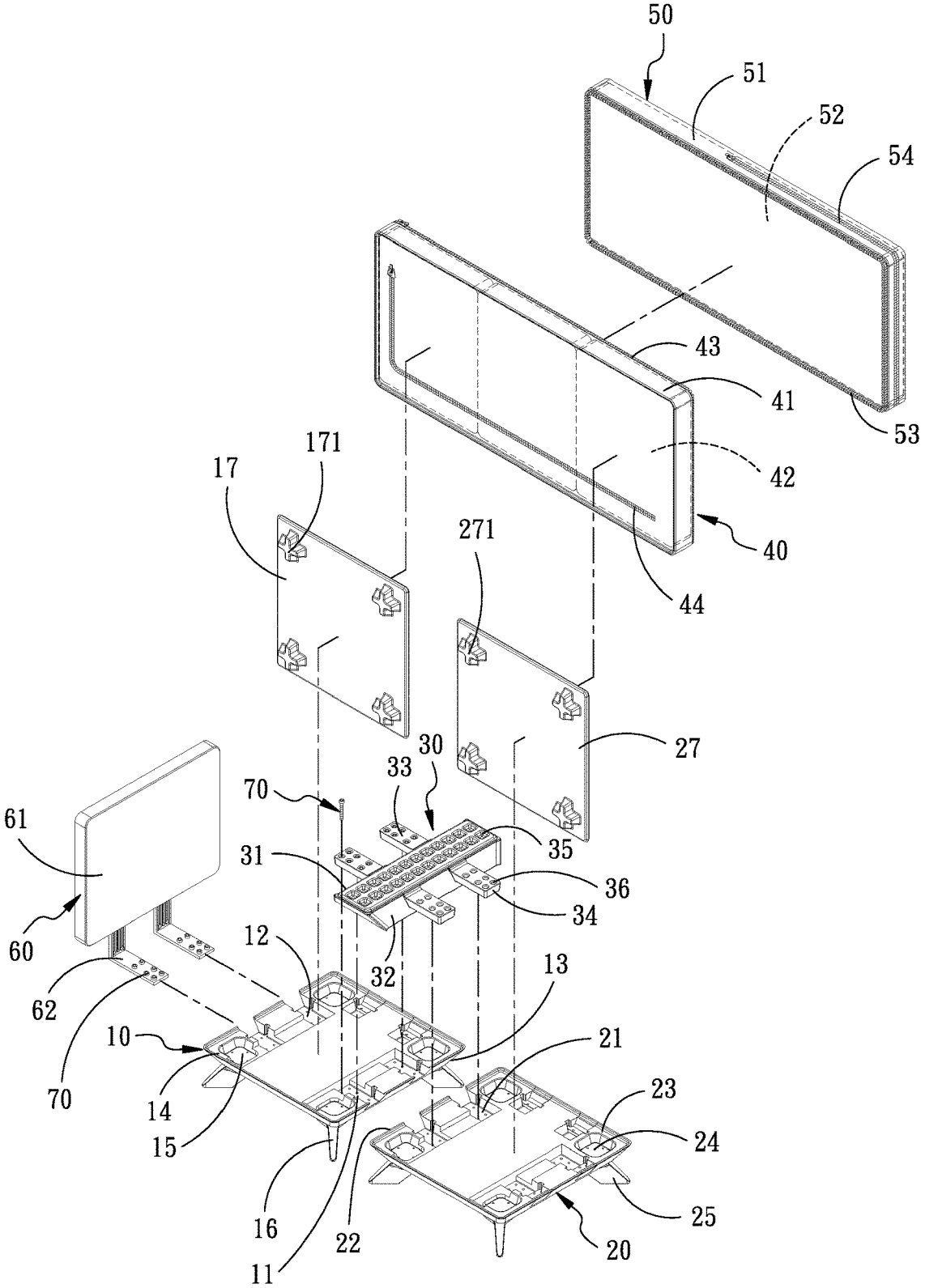
FIG. 3 is another exploded view of the ready-to-assemble bed according to the first embodiment of the present invention.
Figure 4:
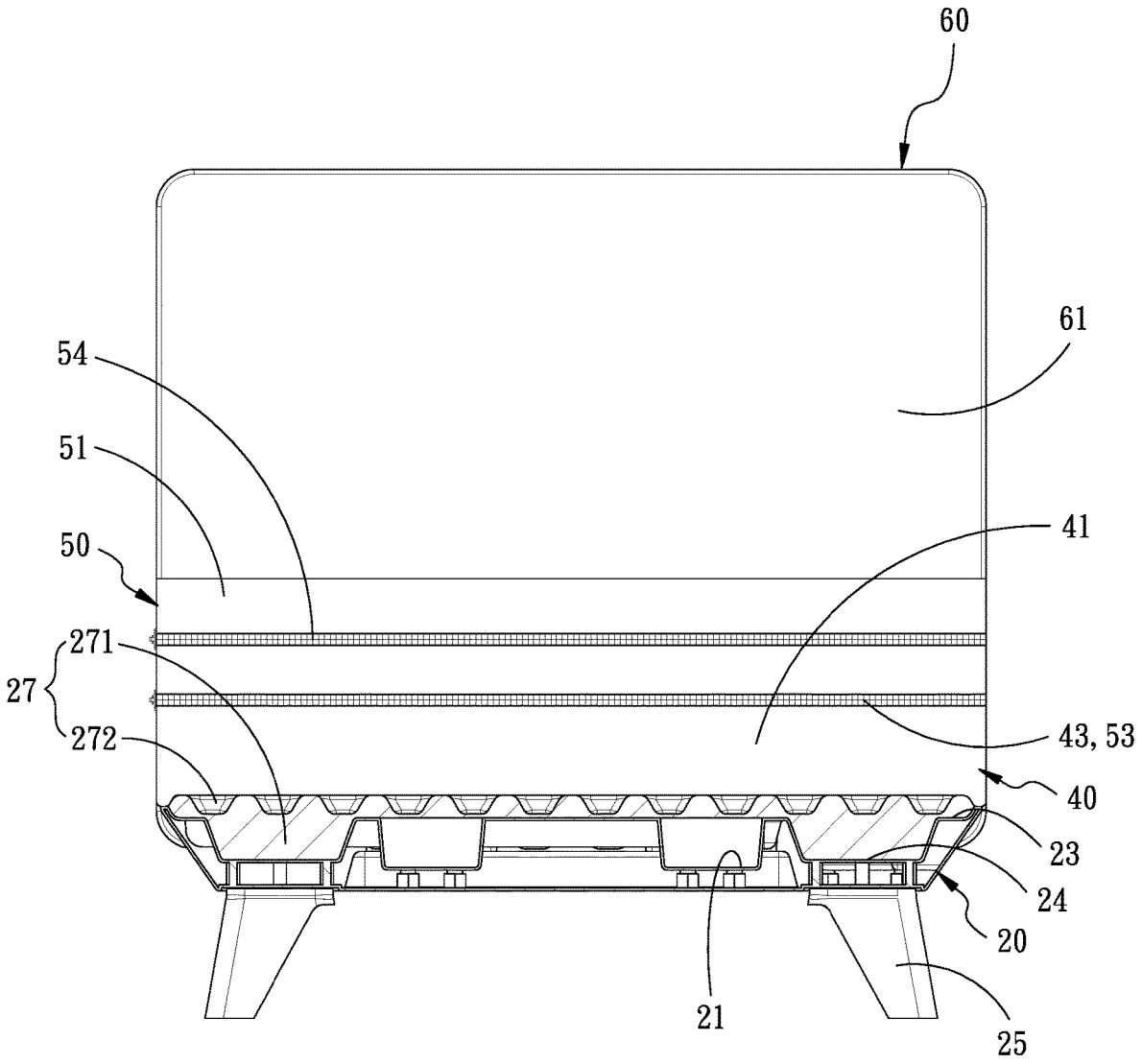
FIG. 4 is a transverse, partially cross-sectional view of the ready-to-assemble bed according to the first embodiment of the present invention, showing that the second base member and the second bottom plate have been combined together.

As shown in FIG. 3, the first base member 10 has at least one first installation notch 11 and at least one combination notch 12 opposite to the first installation notch 11 extending in a horizontal direction. The first installation notch 11 and the combination notch 12 are each two in quantity and the two identical notches 11 or 12 are parallel to each other. The first installation notch 11 has a first ramp 13 at its outer side. The first base member 10 has its top formed with a square first fit basin 14. The first fit basin 14 has its bottom formed with four first pits 15 at its four corners. The first fit basin 14 has a height greater than that of the first pit 15. Additionally, the first base member 10 is configured to stand stably on the ground with legs 16 attached thereto from below at its four corners.

The second base member 20 is structurally similar to the first base member 10. The second base member 20 has at least one second installation notch 21 in the horizontal direction. The second installation notch 21 is two in quantity and the two second installation notches 21 are parallel to each other. The second installation notch 21 has a second ramp 22 at its outer side. The second base member 20 has its top formed with a square second fit basin 23. The second fit basin 23 has its bottom formed with four second pits 24 at its four corners. The second fit basin 23 has a height greater than that of the second pit 24. Additionally, the second base member 20 is configured to stand stably on the ground with legs 25 attached thereto from below at its four corners.

Figure 5:
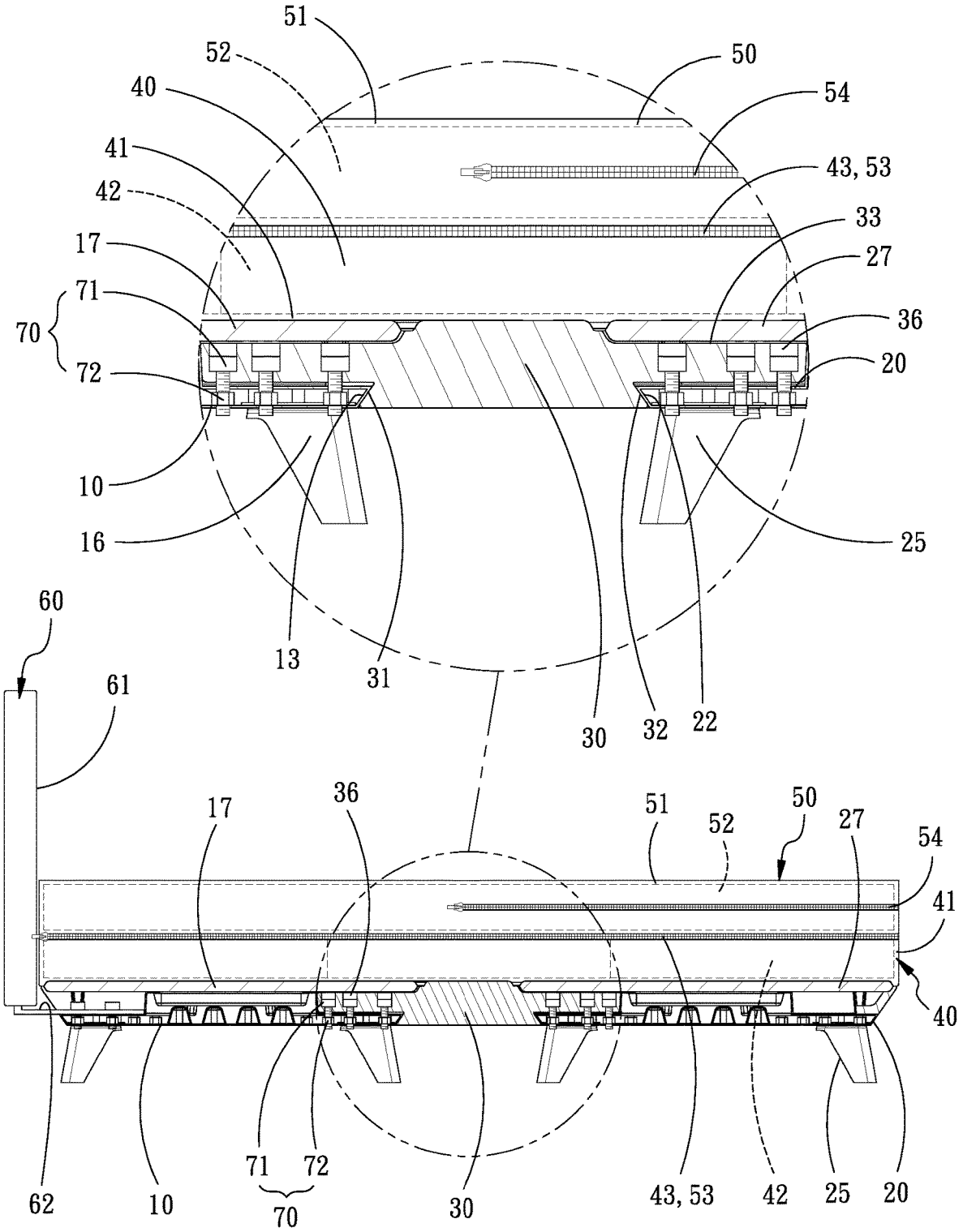
FIG. 5 is a longitudinal, partially cross-sectional view of the ready-to-assemble bed according to the first embodiment of the present invention, showing that the first base member, the second bottom plate, and the connecting member have been combined together.

The connecting member 30 has a third ramp 31 and a fourth ramp 32 that are opposite to each other. The third ramp 31 has at least one first insertion portion 33 extending outward therefrom, and the fourth ramp 32 has at least one second insertion portion 34 extending outward therefrom. The first insertion portion 33 is configured to be detachably combined with the first installation notch 11, and the second insertion portion 34 is configured to be detachably combined with the second installation notch 21, so that the first base member 10 and the second base member 20 are such positioned that they are adjacent to each other and positioned abreast in a longitudinal direction, as shown in FIG. 5. In the embodiment of the present invention, when the first and second base members 10, 20 and the connecting member 30 are assembled, the third ramp 31 abuts against the first ramp 13, and the fourth ramp 32 abuts against the second ramp 22, so that the connecting member 30 fits closely between the first base member 10 and the second base member 20. In addition, the connecting member 30 is fixed to the first base member 10 and the second base member 20 through a fixing unit 70. The fixing unit 70 at least comprises screws 71 and nuts 72, so as to detachably fix the connecting member 30 between the first base member 10 and the second base member 20.

In the embodiment of the present invention, a first bottom plate 17 and a second bottom plate 27 are further provided. The first bottom plate 17 is placed on the first base member 10 and covers the first insertion portion 33. The second bottom plate 27 is placed on the second base member 20 and covers the second insertion portion 34. The first bottom plate 17 and the second bottom plate 27 are for the replaceable resilient cushion 40 to be placed thereon.

The first bottom plate 17 is shaped to match the first fit basin 14, so that the first bottom plate 17 can be fit into the first fit basin 14. The second bottom plate 27 is shaped to match the second fit basin 23, so that the second bottom plate 27 can be fit into the second fit basin 23. The first bottom plate 17 has its bottom formed with four first lumps 171 that are configured to be fit into the corresponding first pits 15. The second bottom plate 27 has its bottom formed with four second lumps 271 that are configured to be fit into the corresponding second pits 24. Thereby, the first bottom plate 17 and the second bottom plate 27 can be firmly combined with the first base member 10 and the second base member 20, respectively.

Figure 2:
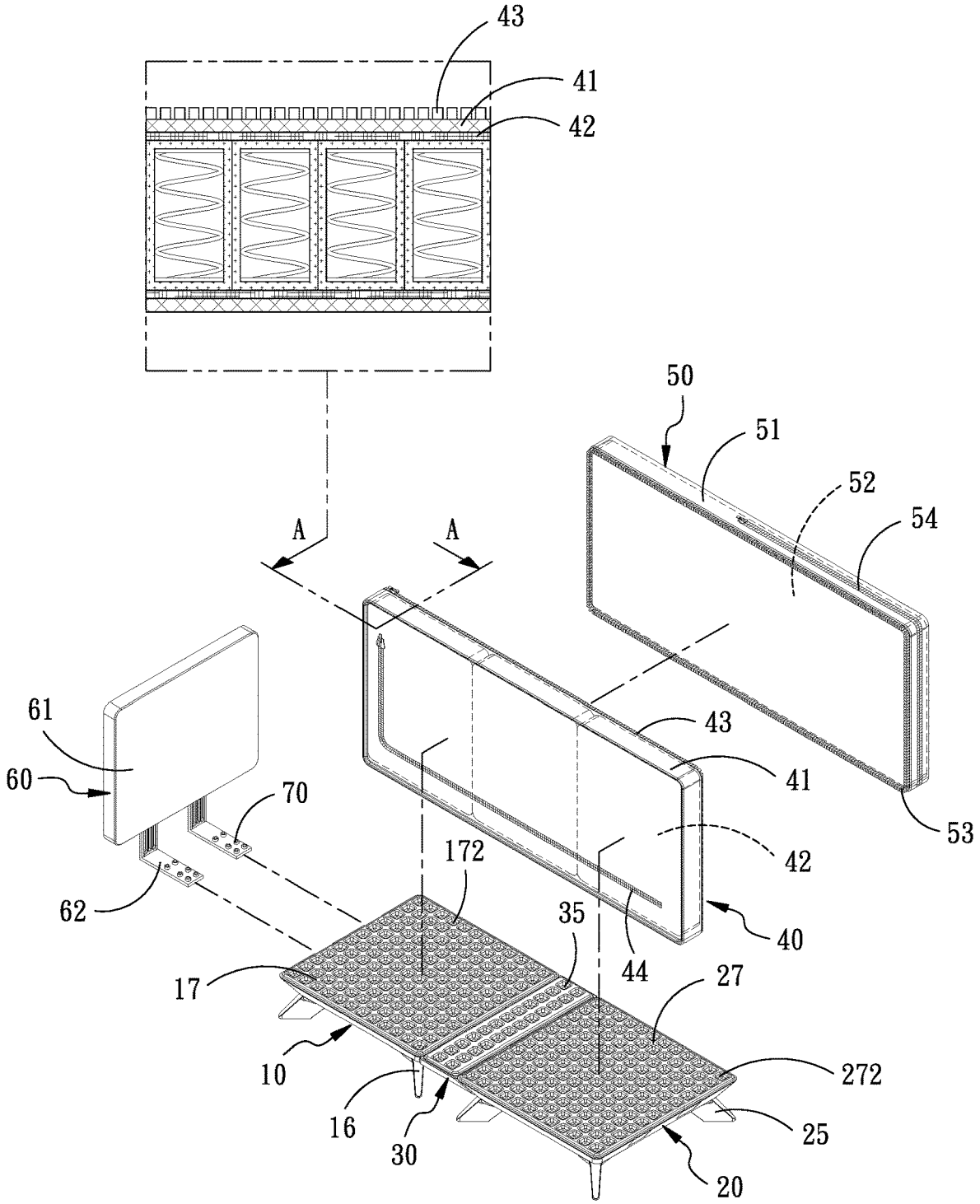
FIG. 2 is an exploded view of the ready-to-assemble bed according to the first embodiment of the present invention, together with a cross-sectional view of a replaceable resilient cushion taken along Line A-A.

Furthermore, as shown in FIG. 2 and FIG. 3, in the embodiment of the present invention, the first bottom plate 17 has its top formed with a plurality of first bores 172, and the second bottom plate 27 has its top formed with a plurality of second bores 272. The connecting member 30 has its top formed with a plurality of third bores 35, while the first insertion portion 33 and the second insertion portion 34 are each atop provided with a plurality of fourth bores 36 that are arranged in the longitudinal direction. Provision of these bores allows the first bottom plate 17, the second bottom plate 27, and the connecting member 30 to be lightened in weight.

The replaceable resilient cushion 40 and the contact pad 50 are each in the form of a single-bed mattress. The replaceable resilient cushion 40 is configured to be placed on the assembled first and second base members 10, 20, and the contact pad 50 is configured to be placed on the replaceable resilient cushion 40 for a user to lay in. The replaceable resilient cushion 40 has a first encasement 41 and a plurality of spring-based resilient chunks 42 to be removably filled in the first encasement 41.

In the embodiment of the present invention, the replaceable resilient cushion 40 has its one side provided with a first connection portion 43 and has its opposite side provided with a first zipper 44. When the first zipper 44 is open, the spring-based resilient chunks 42 can be filled into or removed from the first encasement 41. Therein, each of the spring-based resilient chunks 42 is formed by an array of pocket springs. Herein, the spring-based resilient chunks 42 are three in quantity. The three spring-based resilient chunks 42 may be made with different hardness levels, so that a user can fill the first encasement 41 with the spring-based resilient chunks 42 having different hardness levels according to practical needs and thereby provide his/her different body portions with suitable support. Besides, with such a design, any of the spring-based resilient chunks 42 functionally degrades or is broken can be easily replaced by a new one.

The contact pad 50 is detachably combined with the replaceable resilient cushion 40. The contact pad 50 has a second encasement 51 and a support member 52 to be removably filled in the second encasement 51. In the embodiment of the present invention, the support member 52 is made of latex that can deform under pressure and recover its shape soon after the pressure is removed. The contact pad 50 has a second connection portion 53 at its side facing the replaceable resilient cushion 40. The second connection portion 53 and the first connection portion 43 are both zip-based structure so that they can be detachably combined. Moreover, the contact pad 50 has a second zipper 54 opposite to the second connection portion 53. When the second zipper 54 is open, the support member 52 can be filled into or removed from the second encasement 51.

The headboard 60 has an upholstery portion 61 and at least one fixation portion 62 horizontally extending from the upholstery portion 61. The fixation portion 62 is a pair in quantity. The headboard 60 is detachably combined with the combination notches 12 of the first base member 10 of the bed base through the fixation portions 62. In the embodiment of the present invention, the headboard 60 is fixed to the first base member 10 through the fixing units 70.

Thereby, a user of the disclosed bed can make up the replaceable resilient cushion 40 with spring-based resilient chunks 42 having different hardness levels according to practical needs so as to provide different body portions with suitable support. Moreover, when any of the spring-based resilient chunks 42 has a failure, the user can replace the failed one with a new chunk without discarding other sound chunks, making use of the disclosed bed favorable to environmental protection. Furthermore, since the bed base constructed from the first base member 10, the second base member 20, and the connecting member 30, these components can be packaged, transported, handled, and maintained individually, making use of the disclosed bed much more convenient than traditional monolithic beds.

Figure 6:
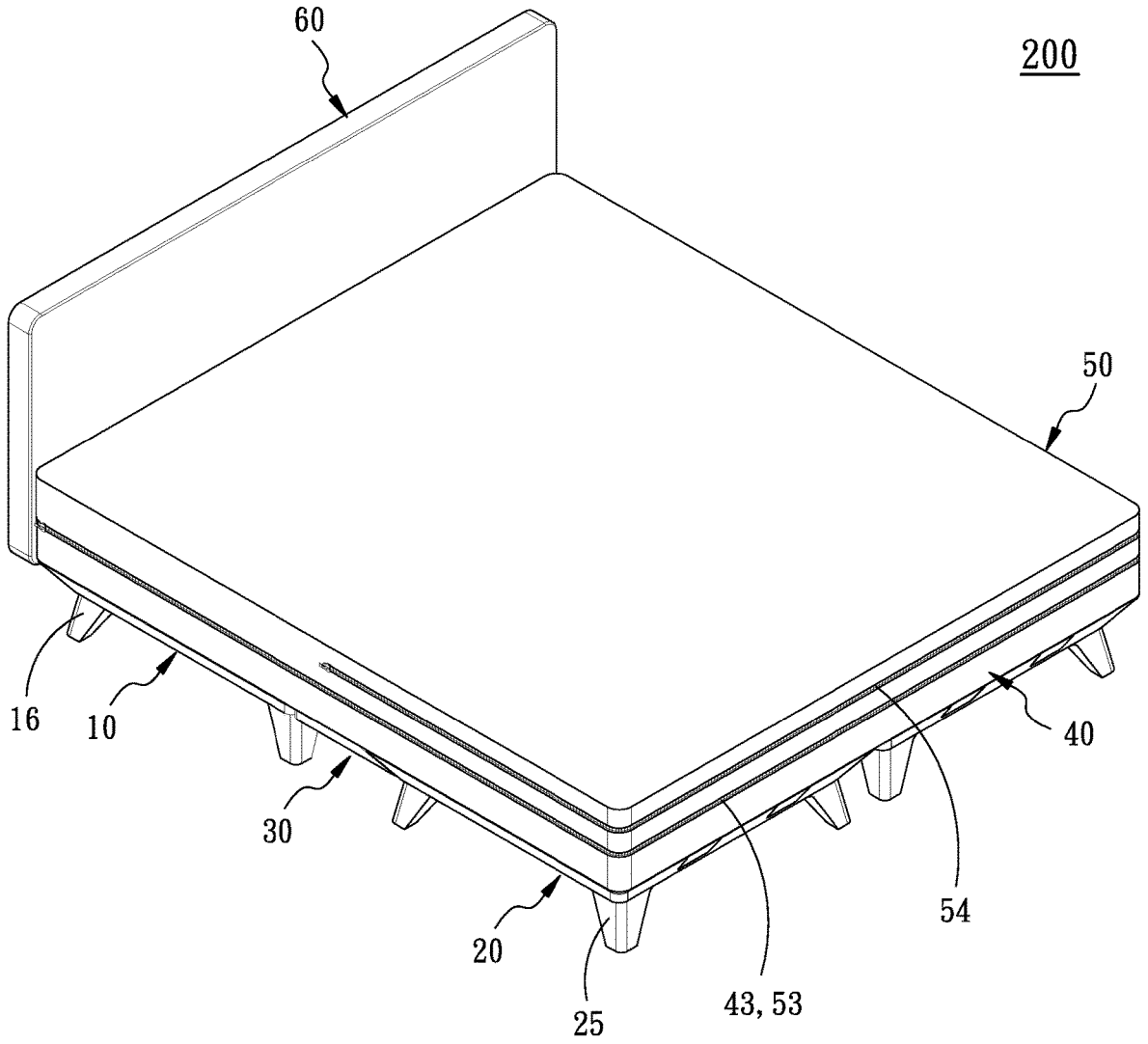
FIG. 6 is a perspective view of a ready-to-assemble bed according to a second embodiment of the present invention, wherein the ready-to-assemble bed is a double bed.
Figure 7:
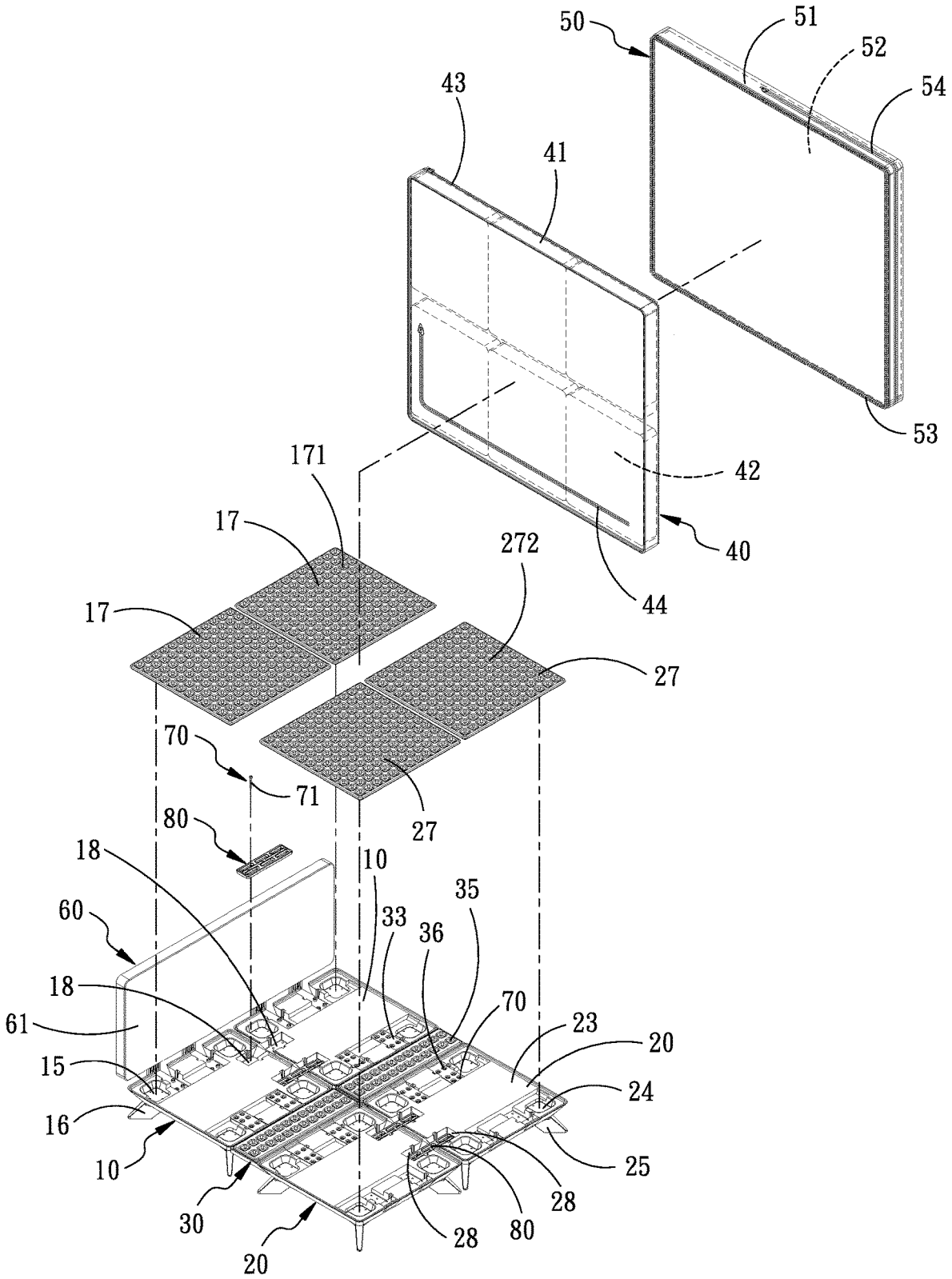
FIG. 7 is an exploded view of the ready-to-assemble bed according to the second embodiment of the present invention.
Figure 8:
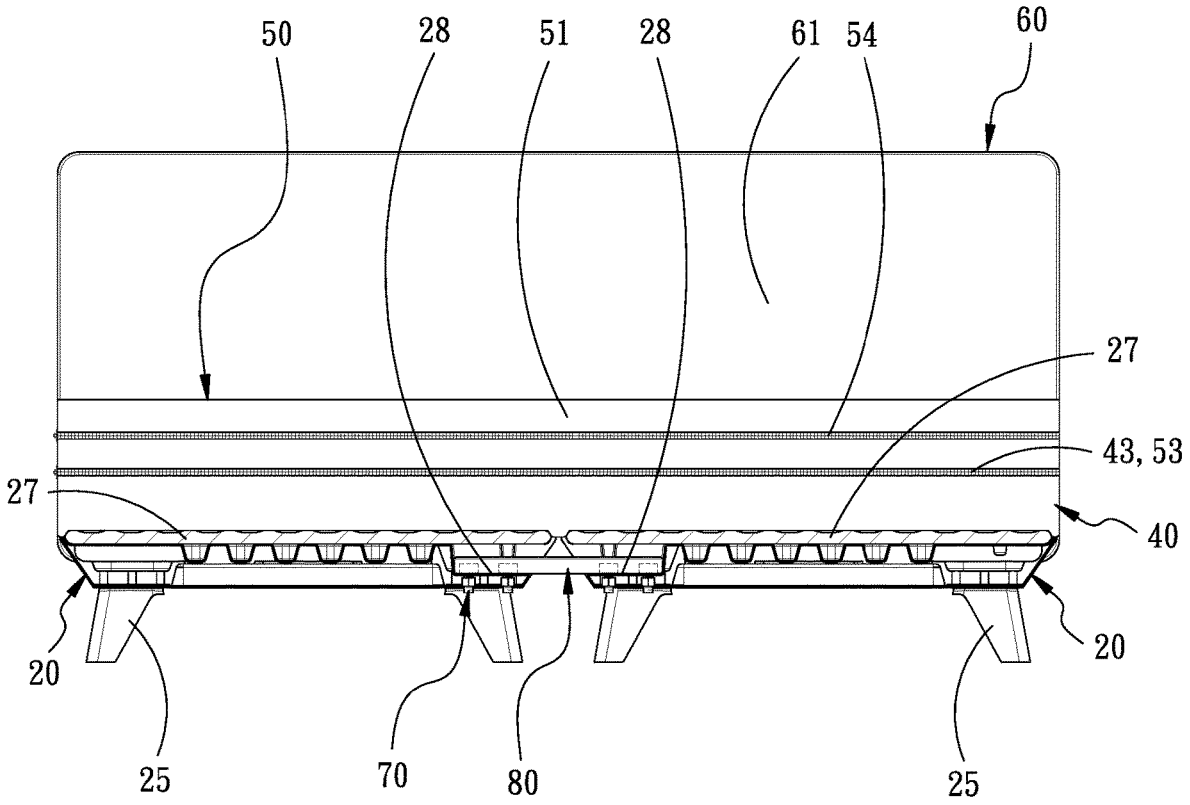
FIG. 8 is a transverse, partially cross-sectional view of the ready-to-assemble bed according to the second embodiment of the present invention, showing that the transverse-connection members and the two second base members have been combined together.

Referring to FIG. 6 through FIG. 8, in the second embodiment of the present invention, a ready-to-assemble bed 200 is a double bed that comprises two first base members 10, two second base members 20, two connecting members 30 that jointly form a bed base; a replaceable resilient cushion 40; a contact pad 50; a headboard 60; and a plurality of transverse-connection members 80.

In this second embodiment, each of the first base members 10 has at least one first lateral connection notch 18 perpendicular to the first installation notch 11. The first lateral connection notch 18 and the first installation notch 11 are the same in quantity. Each of the second base members 20 has at least one second lateral connection notch 28 perpendicular to the second installation notch 21. The second lateral connection notch 28 and the second installation notch 21 are the same in quantity. The first base members 10 and the second base members 20 are detachably combined through the connecting members 30, as described previously.

Moreover, in the second embodiment, the replaceable resilient cushion 40, the contact pad 50, and the headboard 60 are similar to their respective counterparts as described in the first embodiment in terms of structure and combination mechanism, and the only differences are regarding dimensions and the number of spring-based resilient chunks 42 that make up the replaceable resilient cushion 40. Thus, all repeated descriptions are omitted herein.

The transverse-connection members 80 are four in quantity. They are detachably combined with the two adjacent first lateral connection notches 18, so that the two first base members 10 are adjacent and positioned abreast in a transverse direction, and they are detachably combined with the two adjacent second lateral connection notches 28, so that the two second base members 20 are adjacent and positioned abreast in the transverse direction. In the second embodiment, the transverse-connection members 80 are also connected between the two first base members 10 and between the two second base members 20 through the fixing units 70 as mentioned above.

The present embodiment further comprises two first bottom plates 17 and two second bottom plates 27. The first bottom plates 17 are placed on the first base members 10 and cover the first insertion portions 33 and one end of the transverse-connection members 80. The second bottom plates 27 are placed on the second base members 20 and cover the second insertion portions 34 and an opposite end of the transverse-connection members 80. Thereby, a bed base for a double bed is formed and provides effects as those described in the first embodiment.

The present invention has been described with reference to the preferred embodiments and it is understood that the embodiments are not intended to limit the scope of the present invention. Moreover, as the contents disclosed herein should be readily understood and can be implemented by a person skilled in the art, all equivalent changes or modifications which do not depart from the concept of the present invention should be encompassed by the appended claims.

What is claimed is:

1. A ready-to-assemble bed, comprising:

a first base member, having a first installation notch and a combination notch opposite to each other in a horizontal direction;

a second base member, having a second installation notch in the horizontal direction;

a connecting member, having a first insertion portion and a second insertion portion extending outward from two sides thereof, wherein the first insertion portion is configured to be detachably combined with the first installation notch, and the second insertion portion is configured to be detachably combined with the second installation notch, so that the first base member and the second base member when combined are adjacent and positioned abreast in a longitudinal direction;

a replaceable resilient cushion, being placed on the first base member and the second base member, and having a first encasement and a plurality of spring-based resilient chunks configured to be removably filled in the first encasement;

a contact pad, being placed on the replaceable resilient cushion and detachably combined with the replaceable resilient cushion, and having a second encasement and a support member configured to be removably filled in the second encasement; and a headboard, having a fixation portion that is configured to be detachably combined with the combination notch.

2. The ready-to-assemble bed of claim 1, wherein the first installation notch has a first ramp at an outer side thereof, and the second installation notch has a second ramp at an outer side thereof, while the connecting member has a third ramp and a fourth ramp that are opposite to each other, so that when the first and second base members and the connecting member are combined, the third ramp abuts against the first ramp, and the fourth ramp abuts against the second ramp.

3. The ready-to-assemble bed of claim 1, further comprising a first bottom plate and a second bottom plate, wherein the first bottom plate is placed on the first base member and covers the first insertion portion, and the second bottom plate is placed on the second base member and covers the second insertion portion, in which the first bottom plate and the second bottom plate are for the replaceable resilient cushion to be placed thereon.

4. The ready-to-assemble bed of claim 3, wherein the first base member has a first fit basin at a top surface thereof, and the second base member has a second fit basin at a top surface thereof, in which the first bottom plate is configured to be fit in the first fit basin, and the second bottom plate is configured to be fit in the second fit basin.

5. The ready-to-assemble bed of claim 4, wherein the first fit basin is square and the second fit basin is square, in which the first fit basin has a bottom formed with a first pit at each of four corners thereof, and the second fit basin has a bottom formed with a second pit at each of four corners thereof while the first bottom plate has a bottom surface formed with four first lumps that are configured to be fit into the corresponding first pits, and the second bottom plate has a bottom surface formed with four second lumps that are configured to be fit into the corresponding second pits.

6. The ready-to-assemble bed of claim 3, wherein the first bottom plate has a top surface formed with a plurality of first bores, and the second bottom plate has a top surface formed with a plurality of second bores, while the connecting member has a top surface formed with a plurality of third bores, and the first insertion portion and the second insertion portion each have a surface formed with a plurality of fourth bores that are arranged in the longitudinal direction.

7. The ready-to-assemble bed of claim 1, wherein the replaceable resilient cushion has a first connection portion, and the contact pad has a second connection portion that is configured to be connected to the first connection portion, in which the first connection portion and the second connection portion are each of a zipper-based structure.

8. The ready-to-assemble bed of claim 7, wherein the replaceable resilient cushion has a first zipper opposite to the first connection portion, in which when the first zipper is open, the spring-based resilient chunks are allowed to be filled into or removed from the replaceable resilient cushion, and the contact pad has a second zipper opposite to the second connection portion, in which when the second zipper is open, the support member is allowed to be filled into or removed from the contact pad, in which the support member is made of latex, and the spring-based resilient chunks are of different hardness levels.

9. A ready-to-assemble bed, comprising:

two first base members, each having a first installation notch and a combination notch opposite to each other in a horizontal direction, and each having a first lateral connection notch, so that the first lateral connection notches are perpendicular to the first installation notches;

two second base members, each having a second installation notch in the horizontal direction and a second lateral connection notch perpendicular to the second installation notch;

two connecting members, each having a first insertion portion and a second insertion portion extending outward from two sides thereof, wherein the first insertion portions are configured to be detachably combined with the first installation notches, and the second insertion portions are configured to be detachably combined with the second installation notches, so that the first base members and the second base members are adjacent and positioned abreast in a longitudinal direction;

a plurality of transverse-connection members, being configured to be detachably combined with the two adjacent first lateral connection notches, so that the first base members are adjacent and positioned abreast in a transverse direction, and are detachably combined with the two adjacent second lateral connection notches, so that the second base members are adjacent and positioned abreast in the transverse direction;

a replaceable resilient cushion, being placed on the first base members and the second base members, wherein the replaceable resilient cushion has a first encasement and a plurality of spring-based resilient chunks to be filled in or removed from the first encasement;

a contact pad, being placed on the replaceable resilient cushion and detachably combined with the replaceable resilient cushion, wherein the contact pad has a second encasement and a support member to be filled in or removed from the second encasement; and a headboard, having a plurality of fixation portions that are configured to be detachably combined with the combination notches.

10. The ready-to-assemble bed of claim 9, further comprising two first bottom plates and two second bottom plates, wherein the first bottom plates are placed on the first base members and cover the first insertion portions and one end of the transverse-connection members, and the second bottom plates are placed on the second base members and cover the second insertion portions and an opposite end of the transverse-connection members, and wherein the first bottom plates and the second bottom plates are for the replaceable resilient cushion to be placed thereon.

* * * * *